US007255152B2

(12) United States Patent
Friedlich

(10) Patent No.: US 7,255,152 B2
(45) Date of Patent: Aug. 14, 2007

(54) BASEBOARD AND MOLDING SYSTEM

(75) Inventor: William Friedlich, 396 W. 255 St., Bronx, NY (US) 10471

(73) Assignee: William Friedlich, Bronx, NY (US)

( * ) Notice: Subject to any disclaimer, the term of this patent is extended or adjusted under 35 U.S.C. 154(b) by 315 days.

(21) Appl. No.: 10/255,326

(22) Filed: Sep. 26, 2002

(65) Prior Publication Data

US 2004/0069447 A1 Apr. 15, 2004

(51) Int. Cl.
*F24D 5/10* (2006.01)

(52) U.S. Cl. ..... 165/53; 165/76; 165/182; 237/79

(58) Field of Classification Search ..... 163/53, 163/55, 56, 76, 182; 237/79
See application file for complete search history.

(56) References Cited

U.S. PATENT DOCUMENTS 2,477,824 A * 8/1949 Reiss ..... 165/55
2,487,287 A * 11/1949 Weber et al. ..... 165/55
2,782,007 A 2/1957 Glatt
2,909,981 A 10/1959 Stock
3,141,499 A 7/1964 Bunten
3,448,795 A * 6/1969 McNabney ..... 165/55
3,596,058 A * 7/1971 Steiner ..... 165/53
3,844,340 A * 10/1974 Rasmussen ..... 165/55
4,195,687 A * 4/1980 Taziker ..... 165/182
5,597,033 A 1/1997 Cali
5,992,509 A 11/1999 Fennesz

* cited by examiner

*Primary Examiner*—Ljiljana Ciric
(74) *Attorney, Agent, or Firm*—Lackenbach Siegel, LLP; Myron Greenspan

(57) ABSTRACT

A baseboard system includes baseboard units through which conduits extend carrying heated fluids, and moldings about the free ends of the baseboards, to provide a generally uniform external surface configuration. The moldings are in the nature of conventional moldings made of wood, pressed wood, plastic or the like. The use of the moldings with the baseboards provides an efficient, cost-effective system that produces a uniform appearance and facilitates cleaning.

25 Claims, 15 Drawing Sheets

BASEBOARD AND MOLDING SYSTEM

BACKGROUND OF THE INVENTION

1. Field of the Invention

This invention generally relates to baseboard heaters, and, more specifically, to a baseboard and molding system that provides sufficient heat exchange while providing a substantially continuous profile having a substantially continuous external surface configuration along a selected portion of a wall of an enclosure to be heated.

2. Description of the Prior Art

Numerous baseboard heaters have been proposed. For example, U.S. Pat. No. 5,597,033 to Cali discloses a functional baseboard panel that includes a heat transfer tube and a non-functional panel. This non-functional panel provides symmetry in the room and allows for expansion if more functional panels are needed in the room or area. Thus, the non-functional panels serve to provide expansion capability should additional functional sections be required, which could then replace the non-functional panels with functional panels. However, the non-functional sections are essentially blank versions of the function sections, and these are intended to possibly be converted at a future date to functional units. There is no teaching or suggestion that the non-functional panels be more in the nature of more conventional moldings made of wood or the like.

In U.S. Pat. No. 5,992,509 to Finnesz, a baseboard is disclosed that has a wooden cover—evidently for aesthetic purposes, though no mention is made that such cover should match any other or surrounding molding in a room or area. U.S. Pat. No. 3,141,499 to Bunten teaches a baseboard radiator with connector units, while U.S. Pat. No. 2,782,007 to Glatt teaches a baseboard radiator. In both of these patents, the baseboard appears to extend about the entire wall length, so that there is presented a uniformity about the room. However, in both cases, there is no suggestion that baseboard units be used in conjunction with matching, non-functional moldings.

In U.S. Pat. No. 2,909,981 to Stock, a ventilating system for a room is disclosed in which there is some coordination with a ventilating system cabinet. However, shelving is used in conjunction with the ventilating system cabinet so that there is no real symmetry or uniform appearance between the heating cabinet and the adjoining shelving.

SUMMARY OF THE INVENTION

It is an object of the present invention to provide a baseboard system that includes not only baseboard units but similarly shaped moldings at the free ends of the baseboard units, not only to provide an aesthetic appearance of a continuous molding about a wall of an enclosure to be heated, but which molding can also receive, as necessary, conduits carrying heated fluid.

It is another object of the present invention to provide a baseboard system as in the previous objects which effectively provides a continuous member projecting forwardly from the wall that has a substantially continuous external profile or surface configuration, that thereby eliminates edges and corners in the regions of the lateral or free ends of the baseboards, to enhance the appearance of the installation and to facilitate cleaning in the corners at the free ends of the baseboards while preventing damage to the baseboards themselves as well as possibly to vacuum cleaners or other cleaning devices used to clean around the baseboards.

It is still another object of the invention to provide a baseboard system that is simple in construction and economical to manufacture enabling use of multiple materials.

It is yet another object of the invention to provide a baseboard system which is efficient and can be easily modified to provide desired heat transfer properties to heat a space of a given area, insulation and exposure.

It is a further object of the invention to provide a baseboard system, as in the previous objects, which is easy and convenient to install.

It is still a further object of the invention to provide a baseboard system, as suggested in the previous objects, which can accommodate any size or shape enclosure to be heated.

It is yet a further object of the invention to provide a baseboard system which can easily be adapted to any hot water heating system and sized for any standard plumbing parts.

It is an additional object of the invention to provide a baseboard system in which the baseboard heater and the moldings used therewith can be made of different materials.

In order to achieve the above objects, as well as others which will become evident hereinafter, a baseboard system in accordance with the present invention comprises a baseboard unit to be arranged along a wall proximate to floor of an enclosure to be heated. Heating means is provided within said baseboard unit, said baseboard unit defining a predetermined profile or external surface configuration including vertically spaced openings to permit ambient air to flow into and heated air to flow out of said baseboard unit. Said baseboard unit has a predetermined width defined by two opposing lateral ends. Moldings abut each lateral end of said baseboard unit and have a profile or an external surface configuration substantially corresponding to the profile or external surface configuration of said baseboard unit. In this manner, abutment of said moldings against said lateral ends of said baseboard unit substantially continues the external surface configuration of said baseboard beyond the lateral ends thereof to effectively provide a continuous member having a substantially continuous external surface configuration having the appearance of a molding extending along at least a portion of a wall of the enclosure.

Preferably, in one embodiment the baseboard unit is formed of three vertically spaced horizontal members, a space between a lower member and an intermediate member forming an inlet opening for admitting ambient air into said baseboard unit and a space between said intermediate member and an upper member forming an outlet opening for discharging heated air.

The lowermost members are preferably hollow and can serve as conduits for power and data cables. These members can advantageously be at least partially disassembled to simplify installation and to be at least partially removable to allow servicing of the floor, including finishing, sanding and refinishing.

BRIEF DESCRIPTION OF THE DRAWINGS

Other aspects, objects and advantages of the present invention will become apparent upon reading the following detailed description of the preferred embodiment of the present invention when taken in conjunction with the drawings, as follows.

DESCRIPTION OF THE PREFERRED EMBODIMENTS

Figure 1:
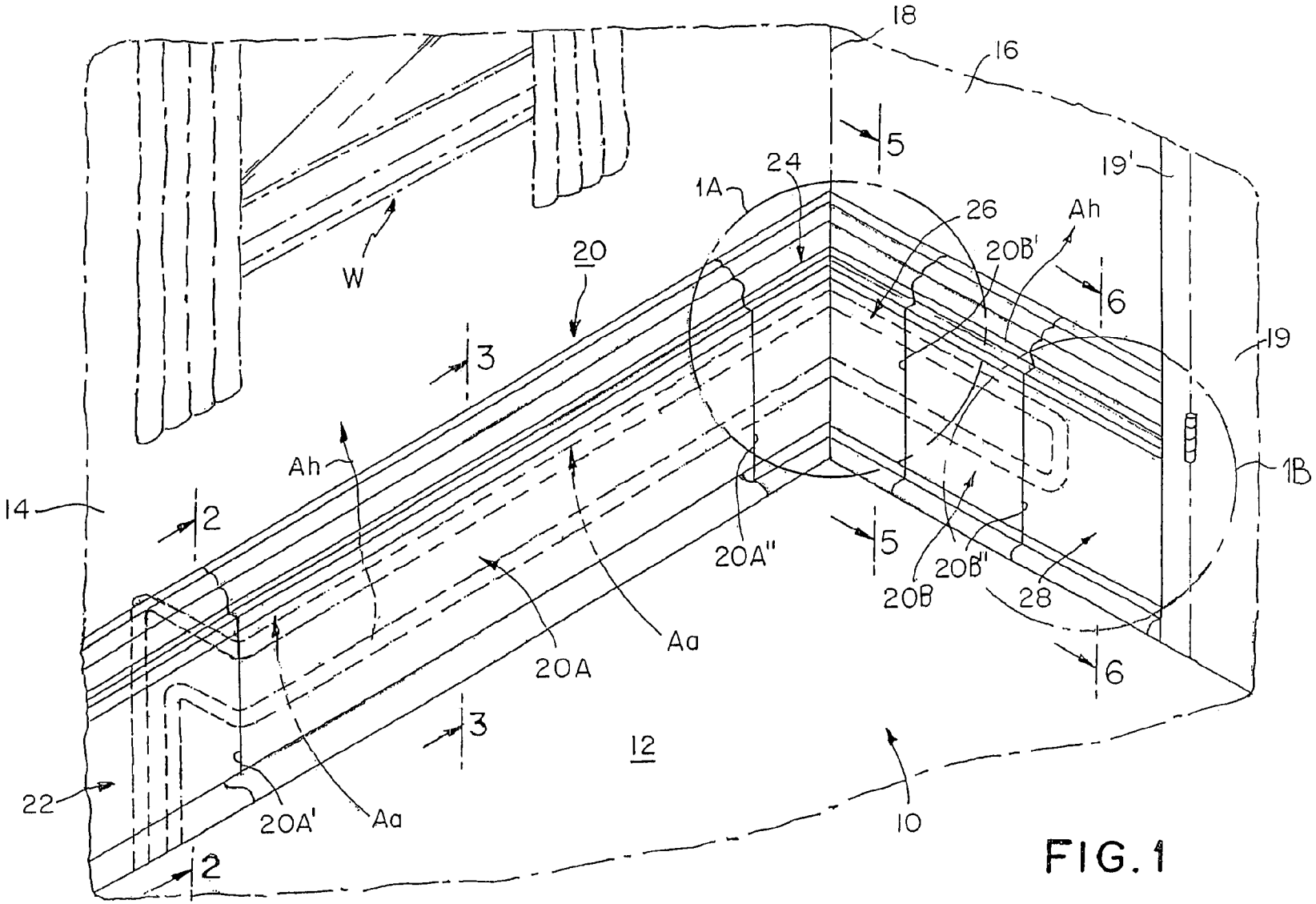
FIG. 1 is a perspective view of one embodiment of a corner of an enclosure to be heated, illustrating the baseboard system of the present invention, including a baseboard provided at the terminal or lateral ends thereof with suitably configured moldings.

Referring now more specifically to the drawings, and first referring to FIG. 1, an enclosure or room to be heated is generally designated by the reference numeral 10, a perspective view of only one corner of a typical room being illustrated. It will become evident from the description that follows that the present invention can be used about the entire periphery of a room or only along a portion of a wall of the enclosure.

The enclosure 10 includes a floor 12 and walls 14 and 16 that meet at a corner 18.

The baseboard system according to the present invention is generally designated by the reference numeral 20. The system 20 includes, in the example shown in FIG. 1, a baseboard unit 20A on the wall 14, such as below window W, and unit 20B somewhat centered in the middle of wall 16 between the corner 18 of the enclosure, and an opening in the wall, namely, door 19. The baseboard units 20A and 20B are arranged along the walls 14, 16, respectively, proximate to the floor 12. The baseboard units include heating means to be more fully described in connection with FIGS. 2-4 and 7.

Each baseboard unit 20A, 20B defines a predetermined external profile or surface configuration and, in the sample shown in FIG. 1, includes vertically spaced openings, to be more fully described in connection with FIG. 3, to allow ambient air $A_a$ to flow into, and heated air $A_h$ to flow out of the baseboard units. The baseboard units each have a predetermined width defined by two opposing lateral ends 20A', 20A" and 20B', 20B". The widths of the baseboard units used in a given enclosure need not be the same. Thus, the baseboard unit 20A, defined by terminal, lateral or free ends 20A' and 20A", is considerably wider than the baseboard unit 20B, defined by terminal, lateral or free ends 20B' and 20B".

Figure 1A:
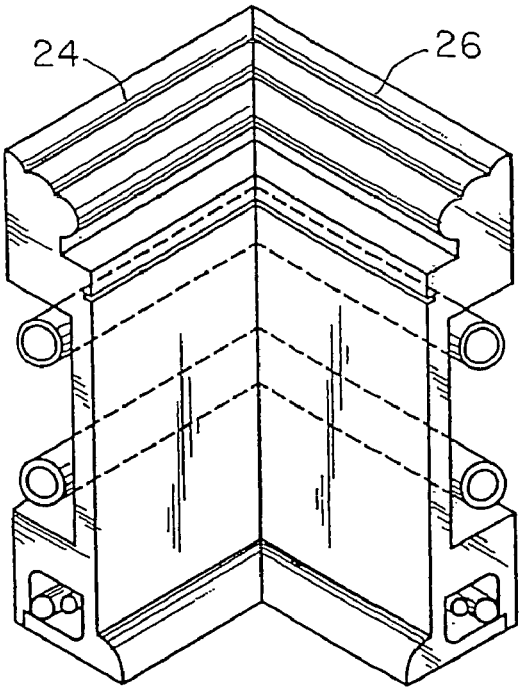
FIG. 1A is an enlarged corner detail of the region IA shown in FIG. 1.
Figure 1B:
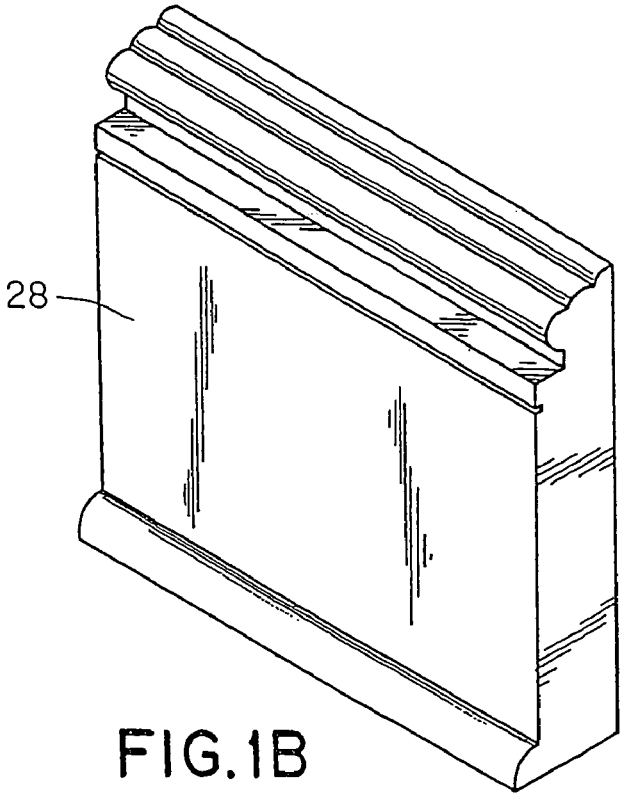
FIG. 1B is an enlarged end detail of the region 1B in FIG. 1.

One aspect of the invention is the provision of moldings 22, 24, 26 and 28, for example shown in FIG. 1, that abut the lateral ends of the associated baseboard units. These moldings have external profiles or surface configurations that substantially correspond to the profiles or external surface configuration of the baseboard units. In this manner, abutment of the moldings 22, 24 against the lateral ends 20A' and 20A", respectively, of the baseboard unit 20A, and abutment of the moldings 26, 28 against the lateral or free ends 20B' and 20B", respectively, of the baseboard unit 20B, as shown, substantially continue the profile or external surface configuration of the baseboard units before the lateral ends thereof to effectively provide a continuous member having a substantially continuous profile or external surface configuration having the appearance of the baseboards/moldings extending along at least a selected portion of a wall of the enclosure. Using moldings that have the same or similar external surface configurations or cross sectional dimensions as the associated baseboard units against which they abut both enhances the aesthetic appearance of the installation and eliminates the sharp edges that might occur at the lateral ends of the baseboard units, and also eliminates corners between such lateral ends and the wall, which are sometimes difficult to clean. Through the elimination of such corners and through providing a continuous and smooth surface configuration, the baseboard units themselves are protected against damage as are vacuum cleaners or other devices that may be used to clean in the region of the baseboard. FIGS. 1A and 1B are enlarged details of the moldings 24, 26 and 28 shown in FIG. 1.

It will be clear that the specific external surface configuration presented by the baseboard units and associated moldings is not critical to the present invention, and such external surface configurations may assume different shapes, sizes, etc. The external surface configurations of the baseboard units and associated moldings may correspond to traditional moldings and match each other so as to enhance the aesthetic appearance of the system and blend with other like or similar moldings in a given structure or enclosure.

Figure 3A:
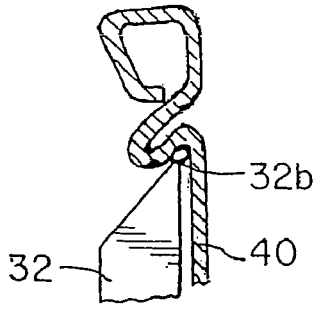
FIG. 3A is an enlarged detail view of the region 3A in FIG. 3.
Figure 3B:
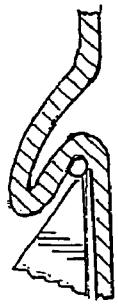
FIG. 3B is similar to FIG. 3A but showing and alternate construction.
Figure 3C:
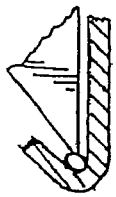
FIG. 3C is an enlarged detail of the region 3C in FIG. 3.
Figure 2:
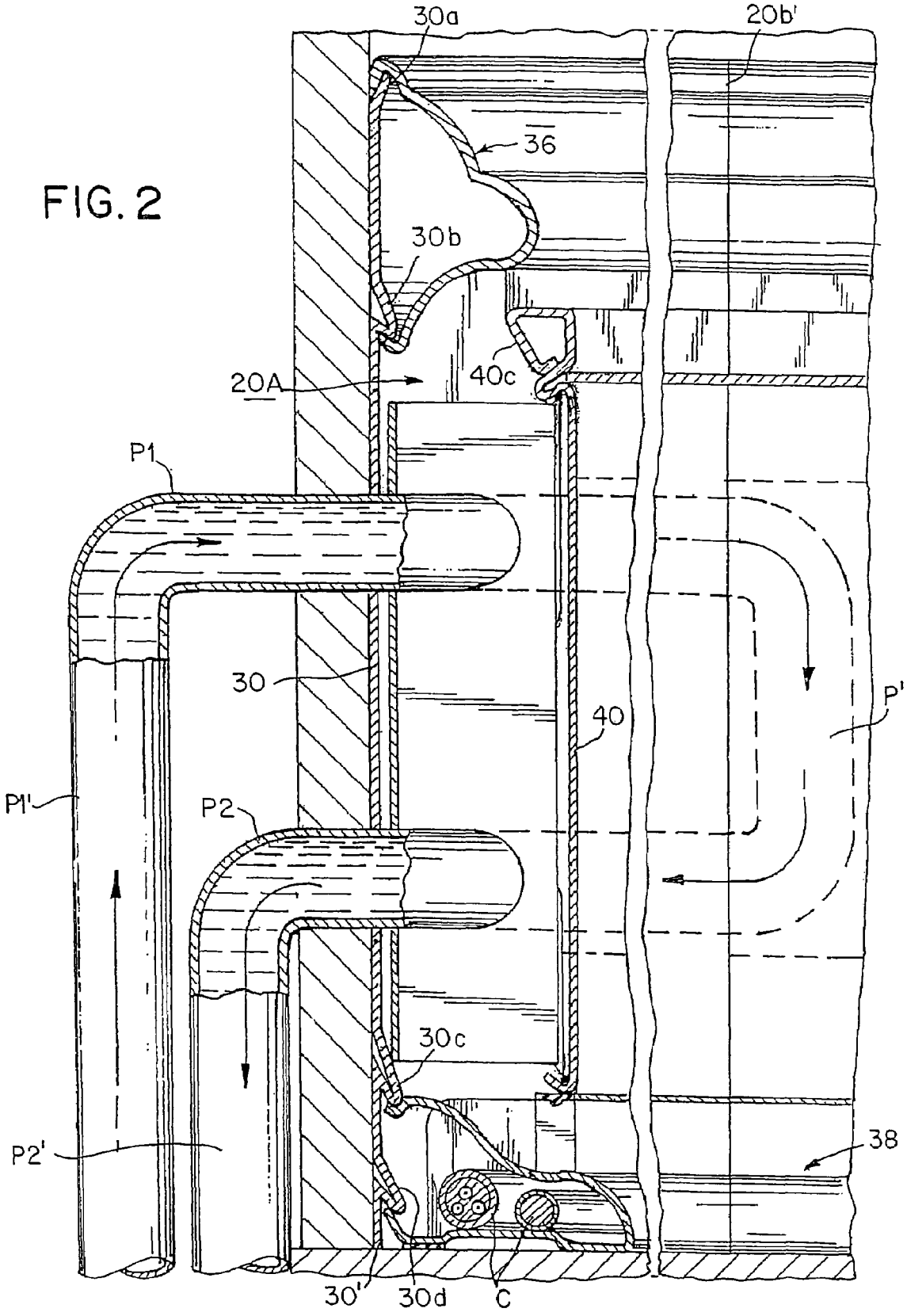
FIG. 2 is an enlarged cross sectional view of the baseboard unit shown in FIG. 1, as viewed along section 2-2.
Figure 3:
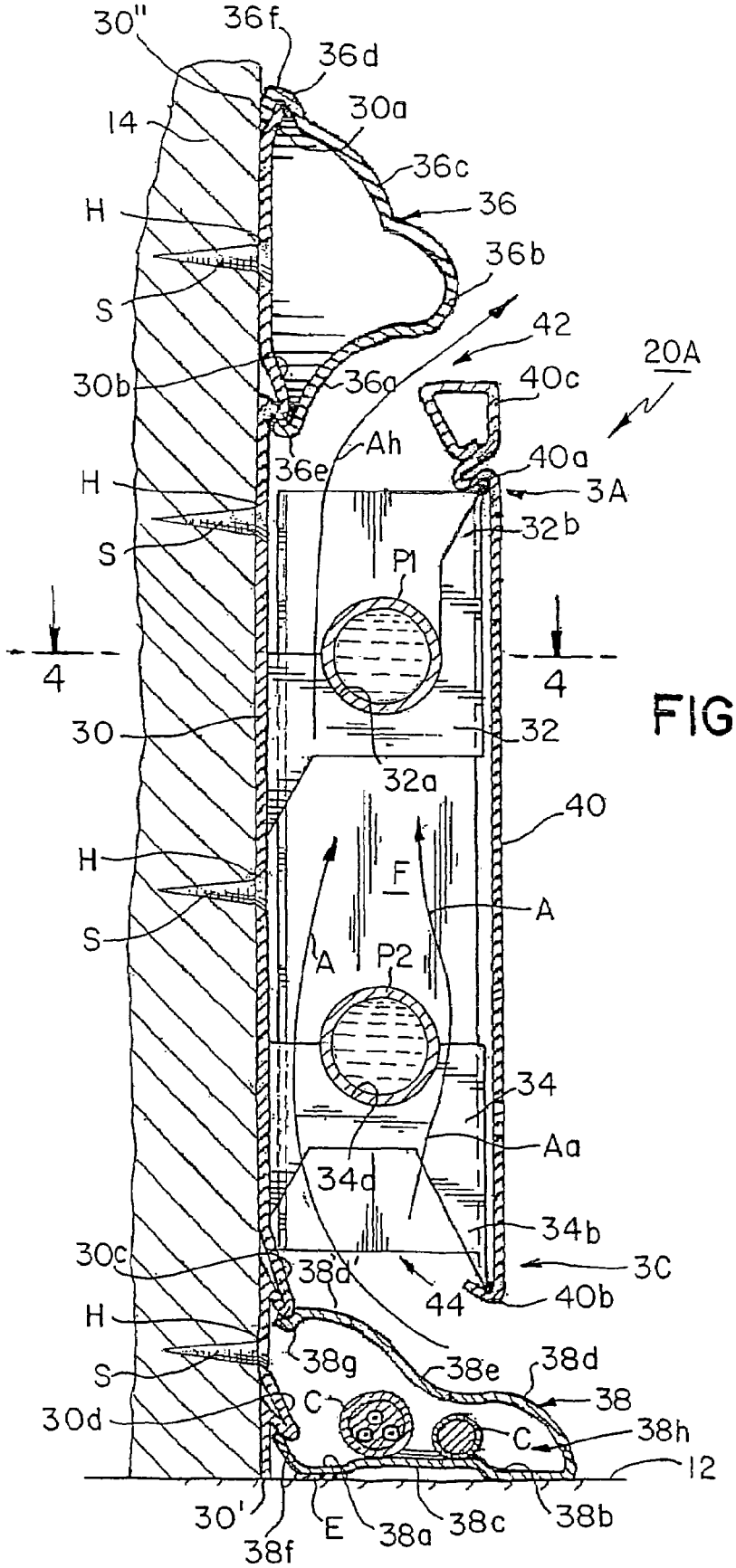
FIG. 3 is an enlarged cross section view of the baseboard unit shown in FIG. 2, taken along section 3-3.

Referring to FIGS. 2 and 3, additional details are illustrated of a presently preferred embodiment of a baseboard system in accordance with the present invention. Thus, the baseboard units 20A, 20B are each formed of three vertically spaced members, to be described, a space being provided between the lower member and an intermediate member to form an inlet opening for admitting ambient air $A_a$ into the baseboard unit and a space between the intermediate member, or baseplate, and an upper member to form an outlet opening for discharging heated air $A_h$. Suitable attachment means is used for attaching the three members of the baseboard units to the walls. In the presently preferred embodiment, such attaching means is in the form of a vertical, substantially flat backplate 30 that is secured to the wall by any suitable means, such as a series of fasteners or screws S extending through holes H within the backplate 30. The backplate includes protuberances projecting forward, away from the wall, at least one of the members of the baseboard units being configured to engage such protuberances. As suggested in FIGS. 2, 3, and 3J, such protuberances are generally in the form of horizontal projections 30*a*, 30*b*, 30*c* and 30*d*, that are inclined relative to horizontal planes. In one embodiment, at least one of the members comprising the baseboard unit, such as the faceplate 40, is formed of a flexible or deflectable materials (for example steel or aluminum) and provided with projection-engaging means configured to engage the projections 30*a*-30*d* or supporting brackets (to be described), for example when the members are deflected from their normal undeflected states and snap into engagement with the projections 30*a*-30*d* when released to revert to their undeflected states.

In another embodiment of the invention the faceplate 40 may be extruded of a relatively rigid material, such as aluminum or steel, and provided with an upper lip, such as shown in FIGS. 3A, 3B, and a lower lip, such as shown in FIG. 3C for snapping onto associated brackets. Since such extruded base plate is relatively rigid the brackets on which the base plate is mounted may be made flexible or deformable beads or gaskets may be used to allow the base plate to be snapped onto brackets and retained in place. See also FIGS. 3F-3I for other optional profiles can be used for the baseplates 40, showing differently configured upper and lower lips, these being merely illustrative. It should be evident that other configurations may also be used, the specific shape not being critical as long as the baseplate can be mounted on the brackets for covering the central portion of the baseboard unit including the conduits or pipes and the heat transfer fins.

Figure 3D:
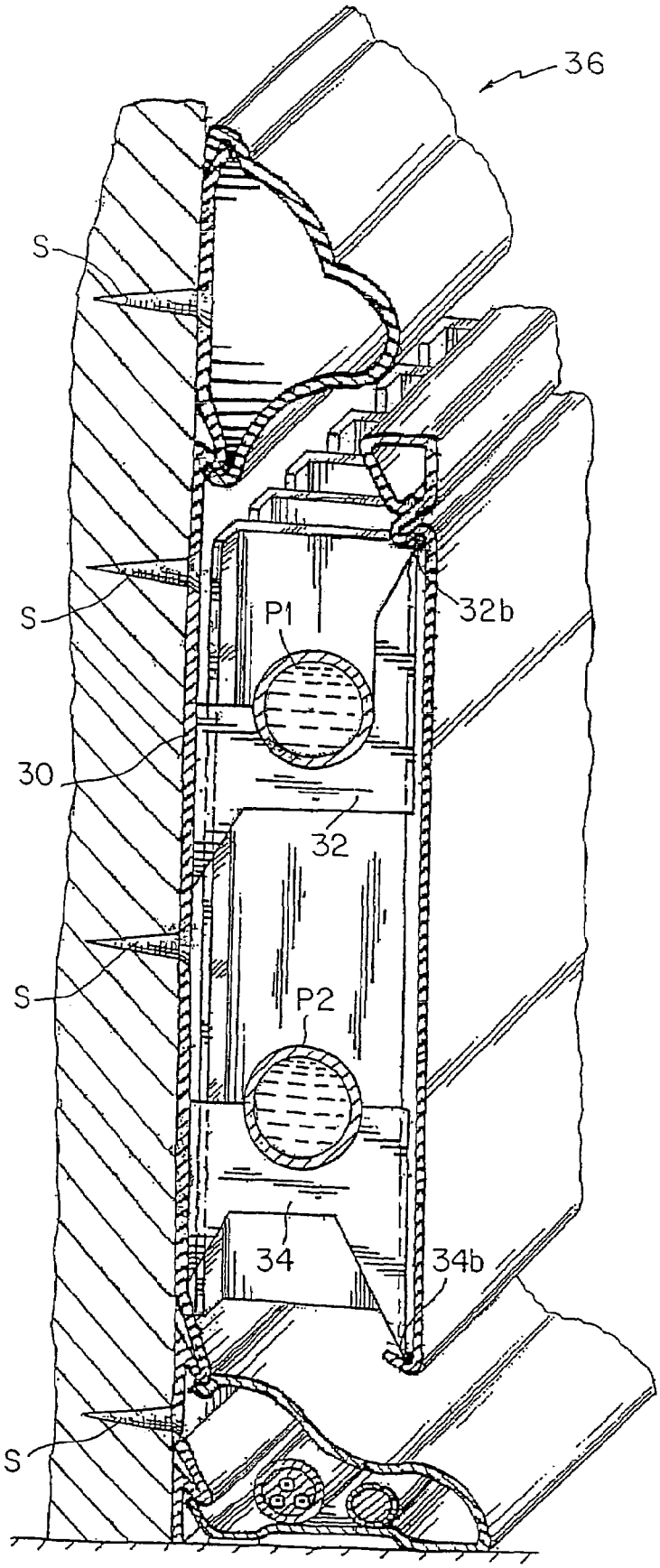
FIG. 3D is a perspective view of the unit shown in FIG. 3.
Figure 3E:
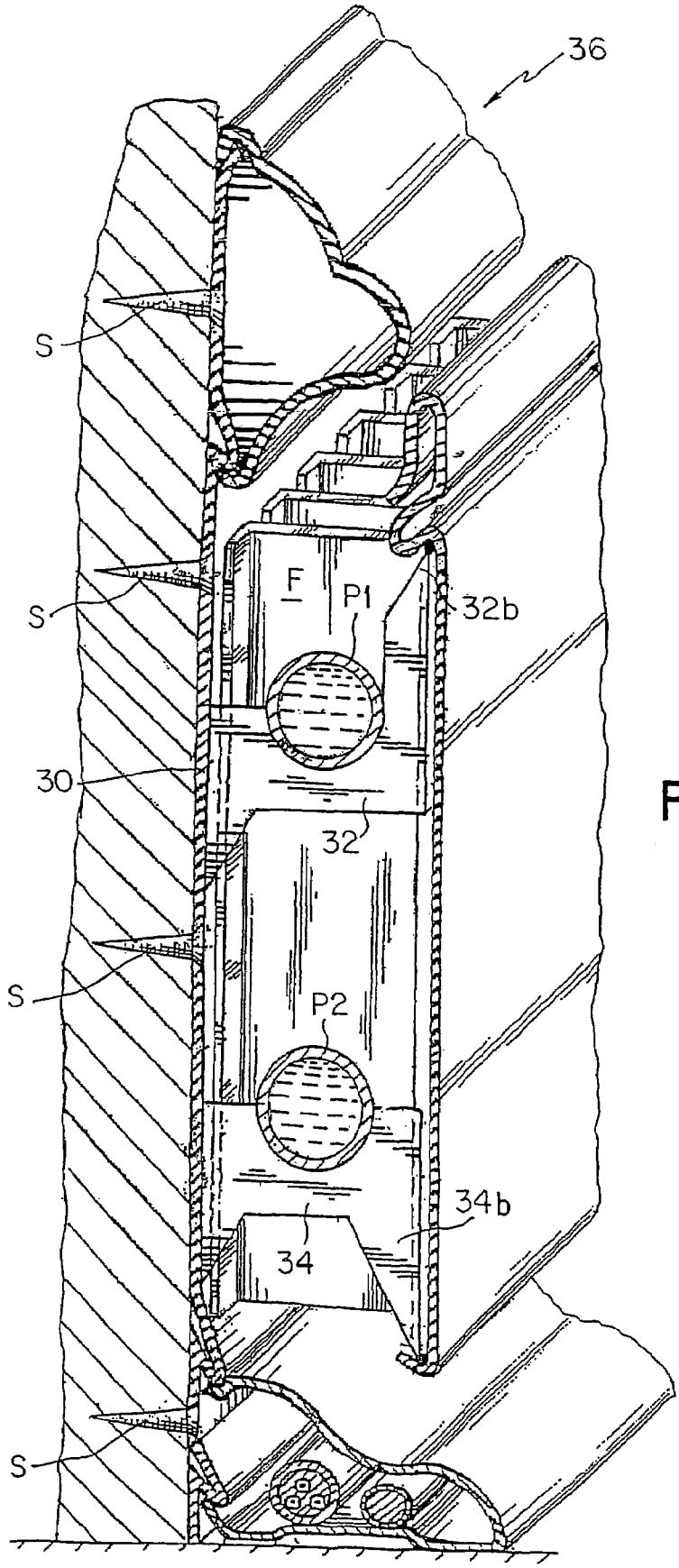
FIG. 3E is similar to FIG. 3D, but showing an alternate construction.
Figure 3F:
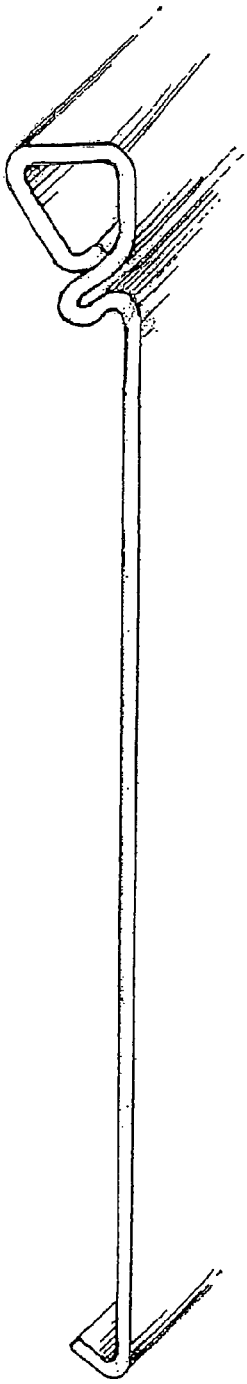
FIG. 3F is a perspective view of the baseplate shown in FIG. 3.
Figure 3G:
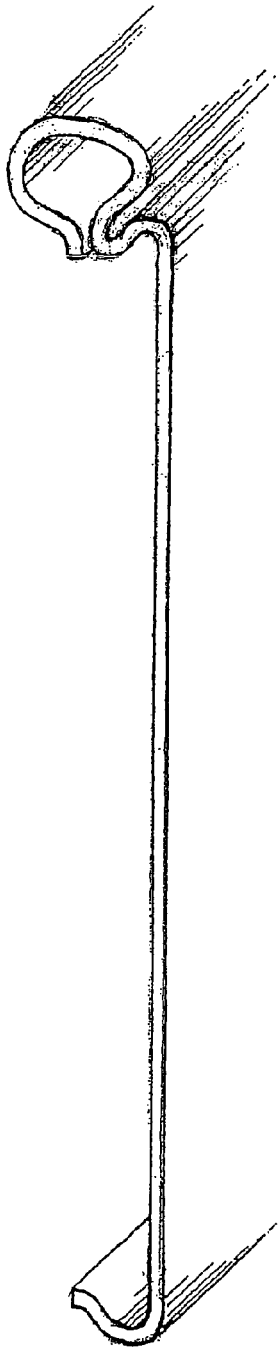
FIG. 3G is similar to FIG. 3F but showing an alternate construction of the baseplate.
Figure 3H:
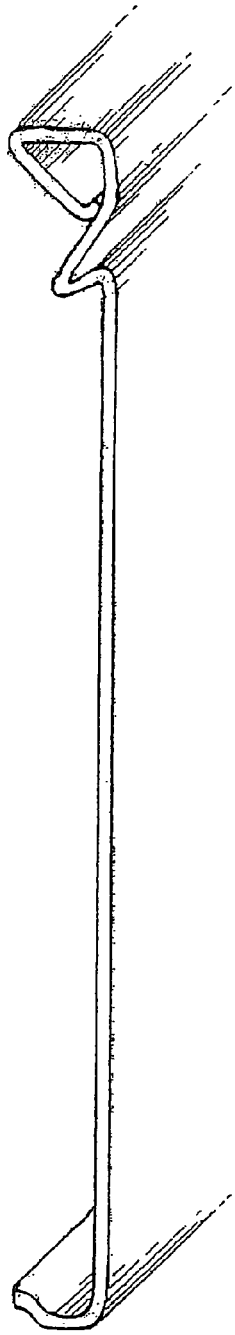
FIG. 3H is similar to FIG. 3F but showing an alternate construction of the baseplate.
Figure 3I:
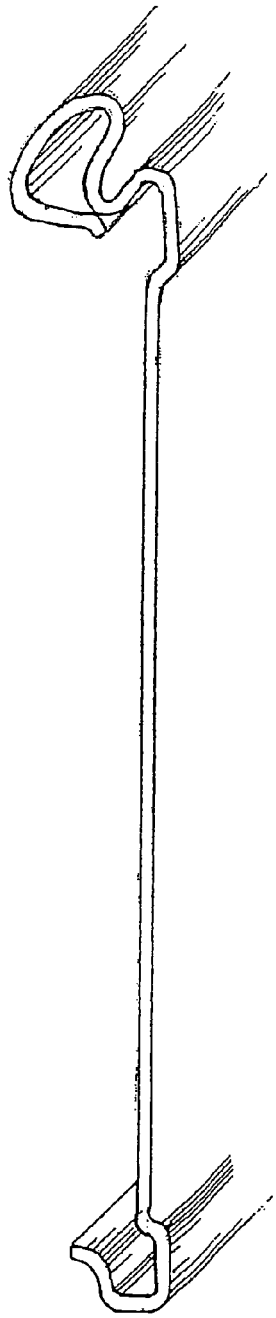
FIG. 3I is similar to FIG. 3F but showing an alternate construction of the baseplate.
Figure 3J:
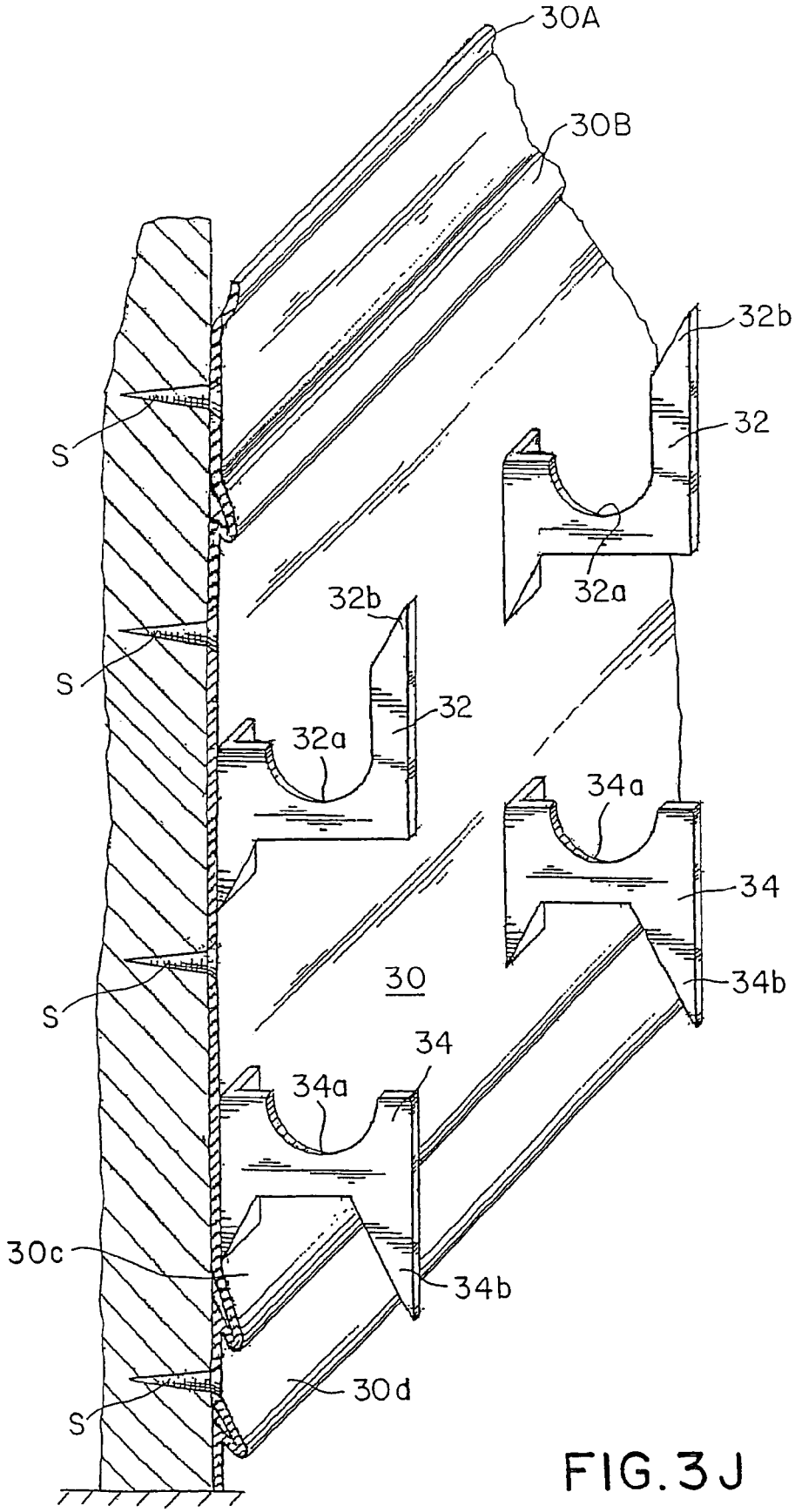
FIG. 3J is a perspective view of the backplate and supporting brackets shown in FIG. 3.

By referring primarily to FIGS. 3, 3D and 3E an upper bracket 32 is shown extending forward from the backplate 30, and a lower bracket 34 similarly extending forward and spaced below the bracket 32. The brackets 32, 34 have upper circular cutouts 32*a*, 34*a*, as shown in FIG. 3J, to receive correspondingly dimensioned pipes or conduits P1, P2, through which flow the fluids of the heating system. Thus, if the conduit P1 is the conduit through which heated fluid flows, conduit P2 is the return for the cooled fluid or, as is to be described in connection with FIG. 7, both conduits, P1 and P2, can conduct the heated fluid of the heating system.

A plurality of bracket 32, 34 may be provided along the length of each baseboard (FIG. 3J), the number of such spaced brackets being determined by the width of the baseboard unit as well as the weight of the conduits supported thereby. Thus, two brackets 32 can be provided at opposing ends of the baseboard units, and, similarly, two brackets 34 can be provided at the ends of the baseboard units, although additional brackets may be provided in between as may be required or desired.

The upper brackets 32 are also provided with upwardly projecting points 32*b*, while the lower brackets 34 are provided with downwardly projecting points 34*b*, to be more fully described.

The upper member of the baseboard unit is generally designated by the reference numeral 36 (FIGS. 2, 3, 3D and 3E), and is shown to be in the form of a profiled member formed of thin material. The upper member 36 includes a lower, generally concave surface 36*a*, almost a quarter of a quadrant of a circle, a round convex nose portion 36*b*, with additional rounded or convex profiles 36*c*, 36*d*, as shown. As suggested, the dimensions and configurations of the convex profiles 36*b*-36*d*, may be selected to generally correspond with or imitate a conventional molding profile, shape or configuration. The concave surface 36*a* is not normally visible by observers within the enclosure 10 except under close scrutiny or examination. The upper member 36 includes an upper projection-engaging hook 36*f* that is configured to engage the protuberance 30*a*, while a lower projection-engaging hook 36*e* projects upwardly to engage downwardly directed projection 30*b*, as shown. Because the upper member 36 is hollow and formed of a flexible and resilient material, it may be snapped onto the projections 30*a* and 30*b* by spreading or separating the projection-engaging hooks 36*e* and 36*f* and snapping them onto the projections of the backplate. As with the faceplate 40, the upper member 36 can also be extruded of a relatively rigid material such as aluminum or steel. In such a design, deformable members, beads or gaskets may be used to facilitate the snapping of the member 36 onto the projections 30*a*, 30*b*. Other locking or supporting devices or designs may be used.

A lower member 38 is provided secured to the backplate 30 and preferably is supported in a stable manner on the floor 12, as shown. In the presently preferred embodiment, the lower member 38 has a cross section generally in the shape of a foot or a shoe, having a rear inner depression 38*a* supported by an elastic gasket or grommet E. Optionally, a second, forward depression 38*b* may rest directly on the floor 12. Aside from the depressions 38*a*, 38*b*, the lower surface of the lower member 38 includes a lower wall 38*c*. The upper part of the member 38 is formed of a profiled or curved surface including two convex regions, 38*d*, 38*d*', between which there is provided a concave surface 38*e*. To secure the lower member 38 to the backplate 30 it is provided with an upwardly directed projection-engaging hook 38*g* configured to engage downwardly directed protuberance 30*c* and an upwardly projecting protuberance-engaging member or edge 38*f* intended to engage the downwardly projected protuberance 30*d*.

As with the upper member 36, the lower member 38 is preferably in the form of a profiled hollow member formed of thin sheet material that can be secured by deforming the lower member 38 so that the hook 38*g* can snap into or engage with the downwardly directed projection 30*c* while the lower hook 38*f* engages the downwardly directed projection 30*d* when the lower member 38 is permitted to revert to its normal, undeflected state, as shown.

The front, generally flat faceplate 40 is secured to the brackets 32, 34 to cover the conduits or pipes P1, P2. Fins F that are supported on the conduits in heat transfer relationship. The faceplate 40 is provided with a longitudinal downwardly directed rib or protuberance 40*a* in the region of the point 32*b* and an upwardly directed edge 40*b* proximate to the lower point 34*b*. The features 40*a*, 40*b* are spaced from each other to snap over or otherwise engage and be supported by the brackets 32, 34, as shown. A profiled upward extension 40*c*, formed in any reasonable shape may be provided to restrict the upper passageway or opening 42 between the intermediate portion or member of the baseboard unit, at 40, and the upper member 36.

Figure 4:
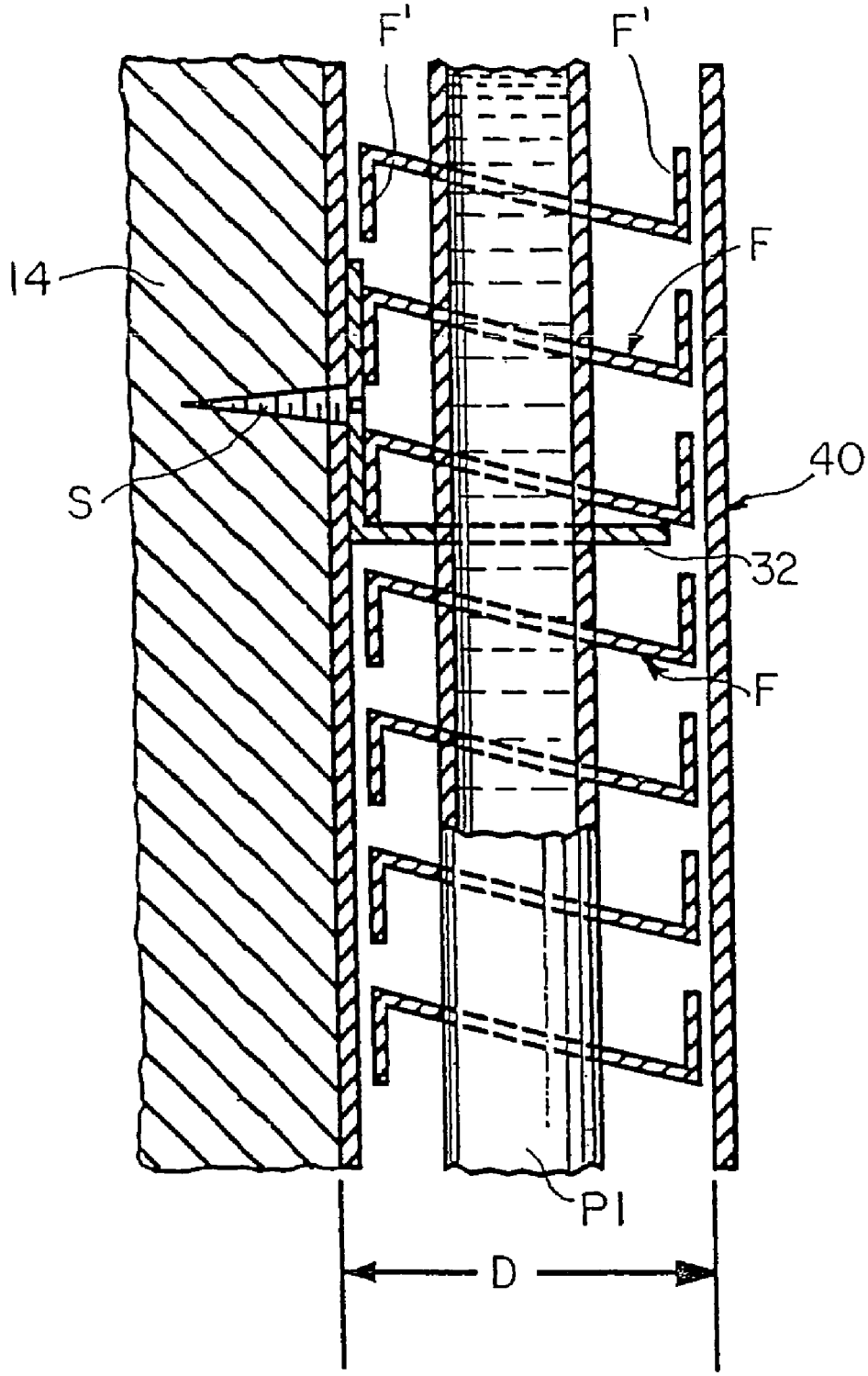
FIG. 4 is a cross sectional view of an intermediate portion of the baseboard unit shown in FIG. 3, taken along line 4-4.

Similarly, a lower passageway 44 is formed between the lower edge 40*b* of the front or faceplate 40 and the lower member 38. The openings 42, 44 are selected to optimize the flow of air A from the lower opening or passageway up past the conduits P1, P2 and the fins F and ultimately, by convection, out the opening or passageway 42. The air that enters through the passageway 44 is ambient air at room temperature in the enclosure or room. After the air passes through the baseboard unit and contacts the plates or fins F of the heat exchanger, as has been described, the heated air exits through the upper opening or passageway 42. The specific construction of the heat exchanger is not critical, and any known heat-exchanging structures may be used. As best shown in FIG. 4, the presently preferred embodiment utilizes fins F, with extensions F', F' that have Z-shaped configurations in horizontal planes to enhance the surface areas and heat-transfer potential of the fins F, while reducing the depth D of the baseboard unit and projection of the baseboard unit from the wall on which it is mounted. However, any suitable fins may be used, bearing in mind that the objective may not be to optimize or maximize heat output but provide desired BTU generation for a given space. The construction, size and number of fins can be readily modified to increase or decrease heat transfer into the enclosure.

As best shown in FIG. 3, the lower member 38, being hollow and proximate to the floor 12, can be used to receive and conceal cables C that may include power cables, telephone and data lines.

Figure 5:
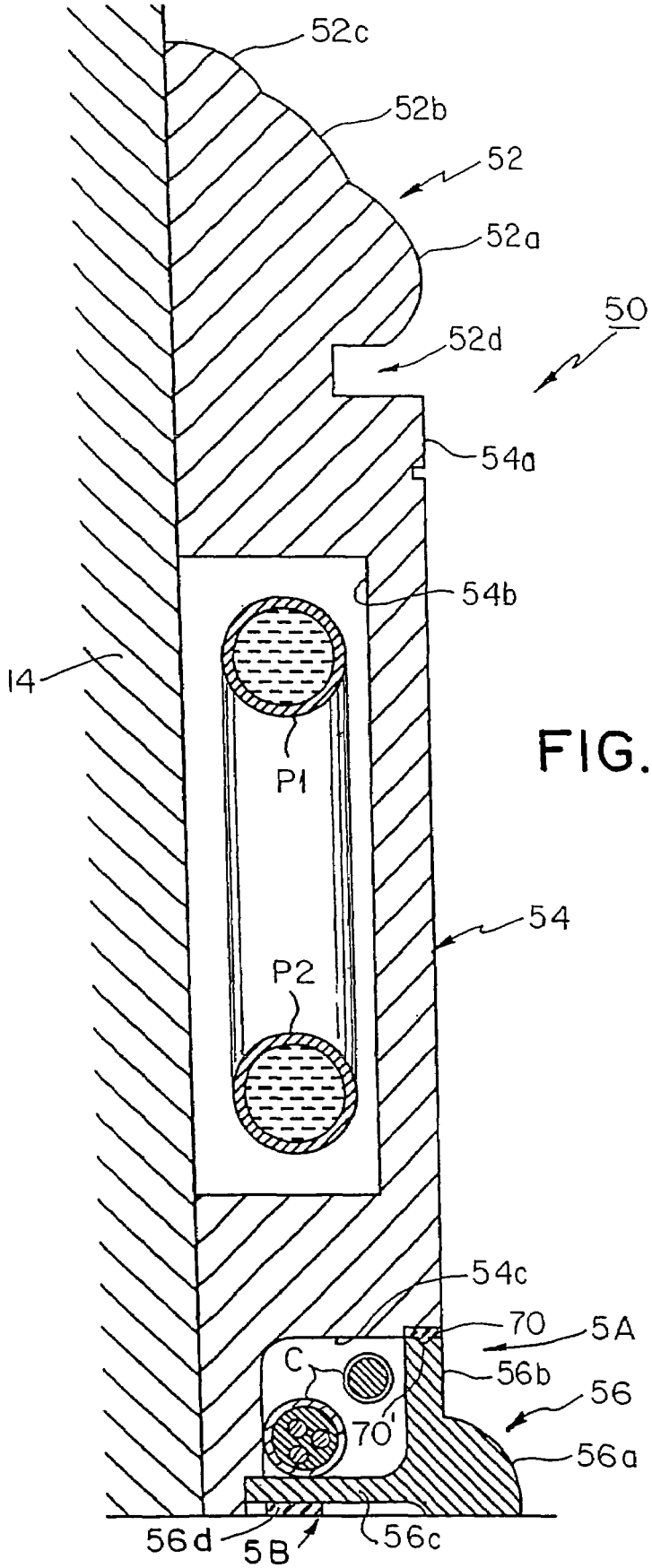
FIG. 5 is an enlarged cross sectional view of a molding in the corner of the room shown in FIG. 1, taken along lines 5-5.
Figure 6:
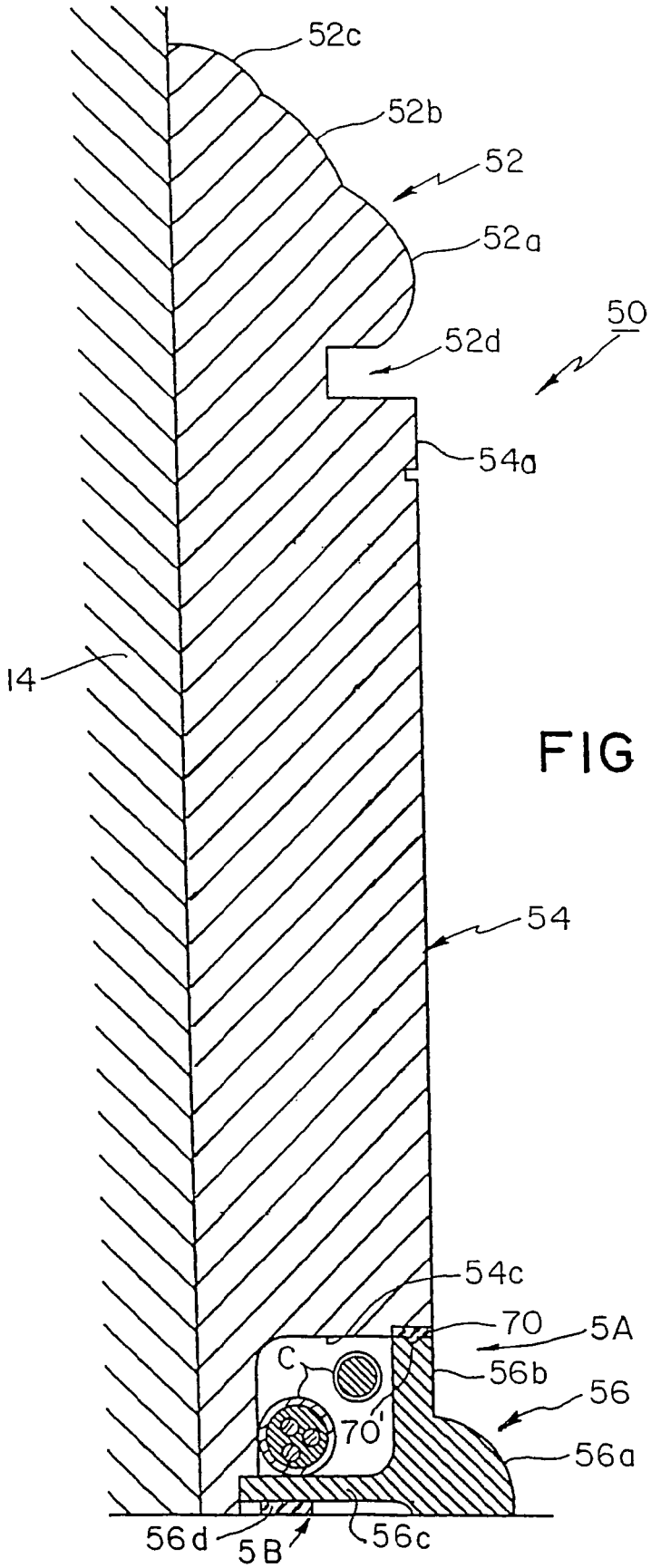
FIG. 6 is similar to FIG. 5, but showing an enlarged cross sectional view of another molding section shown in FIG. 1, taken along the line 6-6 showing a generally solid cross section.

In FIGS. 5 and 6, the cross-sectional configurations of the molding associated or used in conjunction with the baseboard units are shown in cross section. It will be clear from the comparison of FIG. 3, on the one hand, and FIGS. 5 and 6, on the other hand, that the general cross-sectional areas and dimensions of the baseboard unit as well as the moldings are generally the same, and mimic each other in outward appearance. In FIGS. 5 and 6, therefore, a molding 50 is illustrated that has an upper portion 52, an intermediate portion 54 and a lower portion 56. The size and shape upper portion 52 generally correspond to those of the upper member 36 of the baseboard unit, with the shapes and dimensions of the convex or curved 52*a*-52*c* generally corresponding to the shapes 36*b*-36*d*.

The recess 52*d* generally simulates the opening or passageway 42, while the flat intermediate surface at 54 corresponds to the flat surface 40 of the face or frontplate of the baseboard unit. Also, the lower portion 56 of the molding generally simulates the lower member 38. As will be clear, the baseboard unit and moldings need not have the identical, precise or one-to-one correspondence in external shapes or configurations, as long as they generally mimic each so that a casual observer of the baseboard units and moldings would find them to generally have a similar or common configuration. Thus, the curvature 56*a* of the molding should somewhat simulate the curvature 38*d* of the lower member 38.

The moldings may be made of any suitable and conventional materials that can be formed to have the desired profiles. Thus, the moldings may be formed of wood, molded wood chipboard material or extruded molded plastic.

One feature of the moldings 54 is that they may be provided with at least one horizontal channel or recess 54*b*. The region between the upper and lower ends 52, 56 are suitable for receiving heater, fluid-carrying conduits or pipes P1, P2, beyond the lateral ends of the baseboard unit. As best shown in FIG. 1, the conduits within the baseboard unit 20B extend beyond the lateral ends 20B', 20B". The cavities or recesses 54*b* allow the pipes or conduits to continue uninterrupted whether they extend through a baseboard unit or through a molding. Providing the recesses 54*b* serves the additional function of making the moldings lighter and less expensive to manufacture, as the moldings with the recesses require less material. However, as evident from FIG. 6, such moldings may not all be provided with intermediate recesses 54*b*. Only those moldings that are intended to receive conduits need be provided with such recesses. The remaining moldings may optionally be provided with such recesses.

The recesses 54*b* open rearwardly to open in a direction facing the wall of the enclosure, so that the moldings can be slipped over the conduits P1, P2, and secured to the wall without too much effort at the construction site.

The moldings are preferably also provided with at least one horizontal channel at the lower end thereof, proximate to the floor of the enclosure for receiving electrical and/or data cables that normally would be received within the lower member 38 of the baseboard unit and extend beyond the baseboard unit.

Referring to FIGS. 5 and 6, the lower horizontal channel is in the form of a recess 54*c* in a lower portion of the moldings proximate to the floor of the enclosure that extends rearwardly from a front surface of an intermediate portion of the moldings. A cap 56 cooperates with the moldings to cover the recesses and to form therewith the horizontal channel for receiving the cables C.

In the embodiments illustrated in FIGS. 1-3 and 5, the spaced pipes or conduits P1, P2 are arranged in a closed-loop system so that one of the conduit, such as the upper conduit P1, carries heated fluid, while the other conduit, P2, carries cooled fluid. This is also illustrated in FIG. 2.

Figure 7:
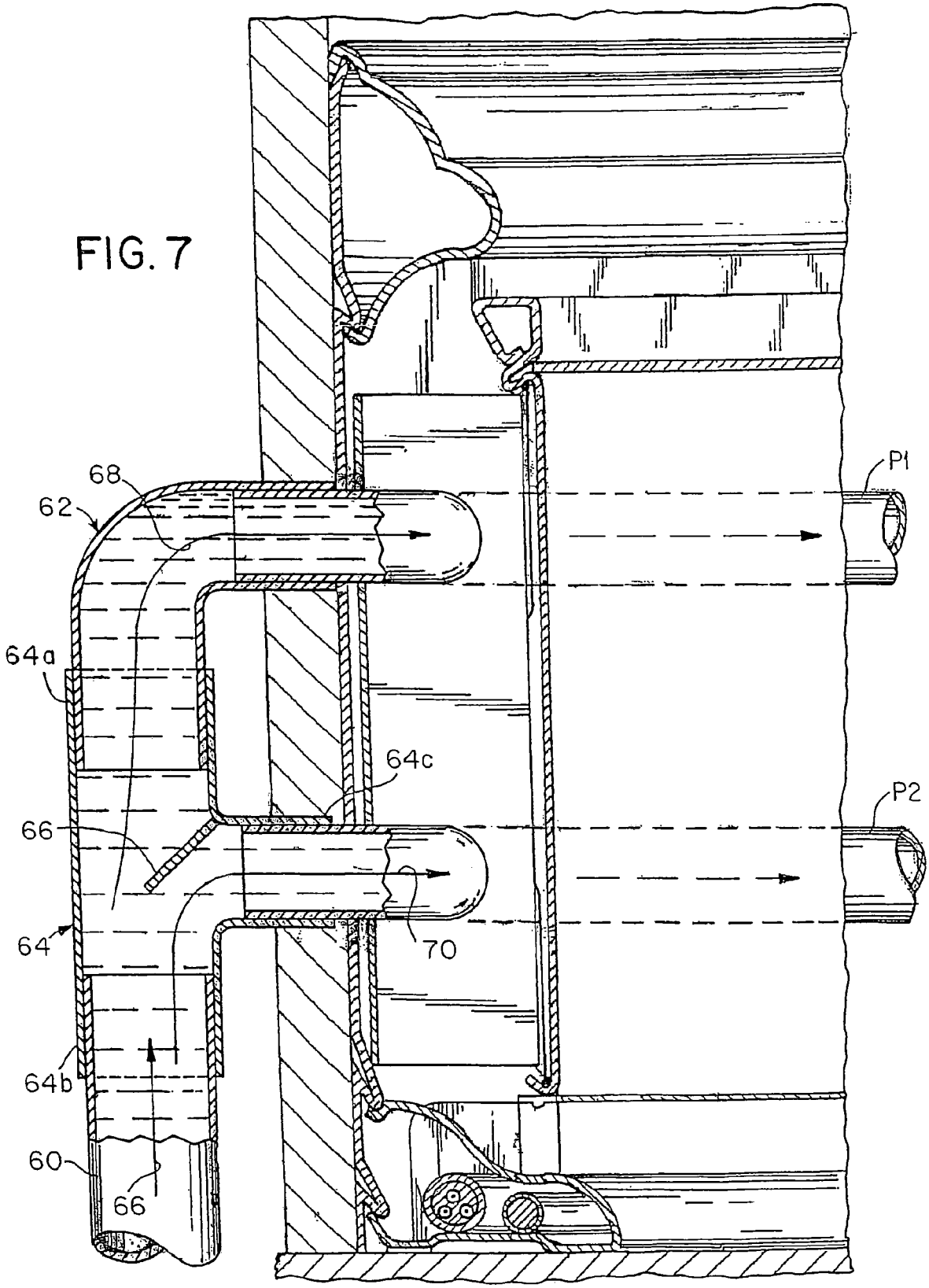
FIG. 7 is similar to FIG. 2 but showing two conduits extending through the baseboard unit that carry heated fluid in the same direction, having been split or diverted by a diverting coupler or connector unit instead of having one conduit carry heated water and the other conduit returning the cooled water in a closed loop system.

In FIG. 7, both the upper and lower conduits P1, P2 carry fluid from a common feeder conduit 60 to the baseboard. The heated fluid flows along direction 66 and is received within a T-shaped coupling 64 for splitting the heated fluid from the common feeder conduit 60 to each of the conduits P1, P2 within the baseboard. To ensure that both conduits P1, P2 are provided with substantially equal amounts of heated fluid, the coupling 64 is preferably provided with a deflecting plate 66 within the coupling for directing substantially equal amounts of heated fluid to both of the conduits.

The invention has been shown and described by way of presently preferred embodiments, and many variations and modifications may be made therein without departing from the spirit of the invention. The invention, therefore, is not to be limited to any specified form or embodiment, except insofar as such limitations are expressly set forth in the claims.

For example, elastic gaskets or beads may be provided between the upper and lower points 32*b*, 34*b* of the support bracket and the longitudinal or horizontal ribs or protuberances 40*a*, 40*b*. Alternatively, a thin plastic strip 70 (FIG. 5) having a bead B may, for example, be provided to have a portion thereof received within a recess 70' of the lower portion 56 to snap the lower portion in place. Any other reasonable means may, of course, be used to secure the lower portion 56 of the molding to the upper portion. A rigid or deformable member 56*d* (FIGS. 5, 6 and 5B) may be provided to provide a press or friction fit and facilitate assembly. However, the lower portion may be secured by suitable fasteners, such as nails 70, without the use of a snap-in-place, as shown in FIGS. 6A-6D. Also, the manner of securing the brackets 32, 34 to the backplate 30 is not critical, as these may be welded to the backplate or secured thereto by means of rivets.

The conduits P1, P2 may be, for example, half-inch ID thin walled pipe, or another common size of pipe. The fins F are typically much thinner than the outer case or backplate, as many such fins are typically mounted closely spaced to each other on the conduits or pipes in order to increase the effective surface area through which heat exchange can take place.

Also, while shaped fins or plates have been illustrated, it should be clear that any other suitable shapes can be used in order to conform to the required dimensions of the baseboard units, as well as the efficiencies required for heat transfer.

As suggested previously, the combination of baseboard units and associated or corresponding moldings can be used about the entire perimeter of a room or enclosure, or only along some of the walls. This choice will depend on the amount of heat that is to be brought into the enclosure, as well as the other properties of the enclosure, including the number of doors, etc.

Figure 8:
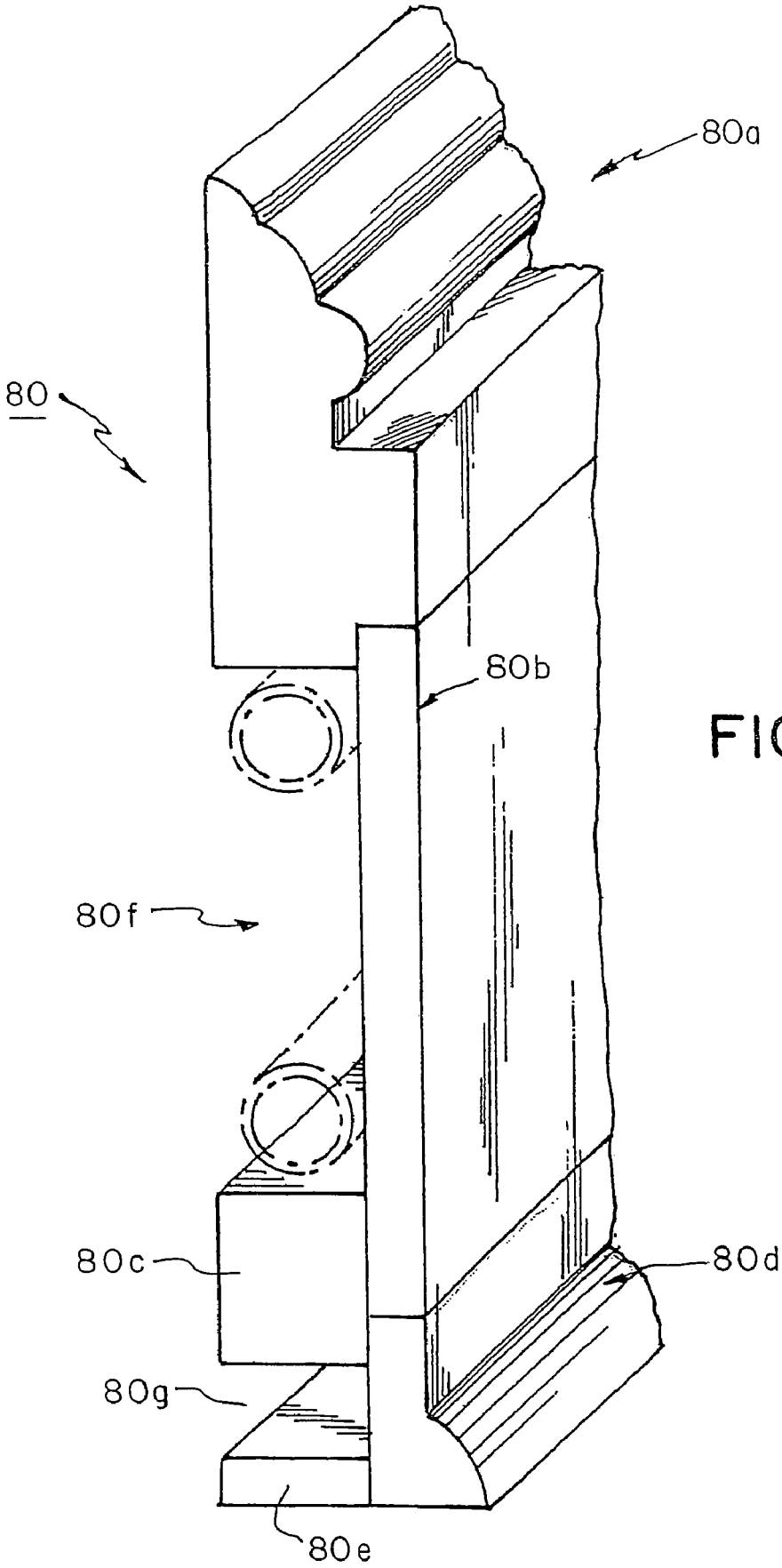
FIG. 8 is similar to FIGS. 5 and 5 but showing an alternate molding construction.

FIG. 8 shows an alternate construction of a molding 80 that generally conforms to the shape of the moldings shown in FIGS. 5 and 6. However, the molding 80 is itself is easily and conveniently constructed using individual members. Thus, an upper member 80*a* corresponds generally to the upper portion 52, the central member 80*b* corresponds generally to the intermediate portion 54 and the lower member 80*d* corresponds generally to the lower portion 56. Suitable spacers 80*c* and 80*e* are used to provide desired spacing from the wall and to provide pipe-receiving and cable-receiving compartments 80*f* and 80*g*, respectively. Again, the specific profiles are not critical so longs as they generally correspond to the associated baseboard heater units with which they are used. While the previous embodiments discussed the use of suitable materials for construction during extrusion, it is obvious from the embodiment, that suitable materials for this embodiment may differ to include wood, plastic, or tile rather the extruded materials.

Figure 9:
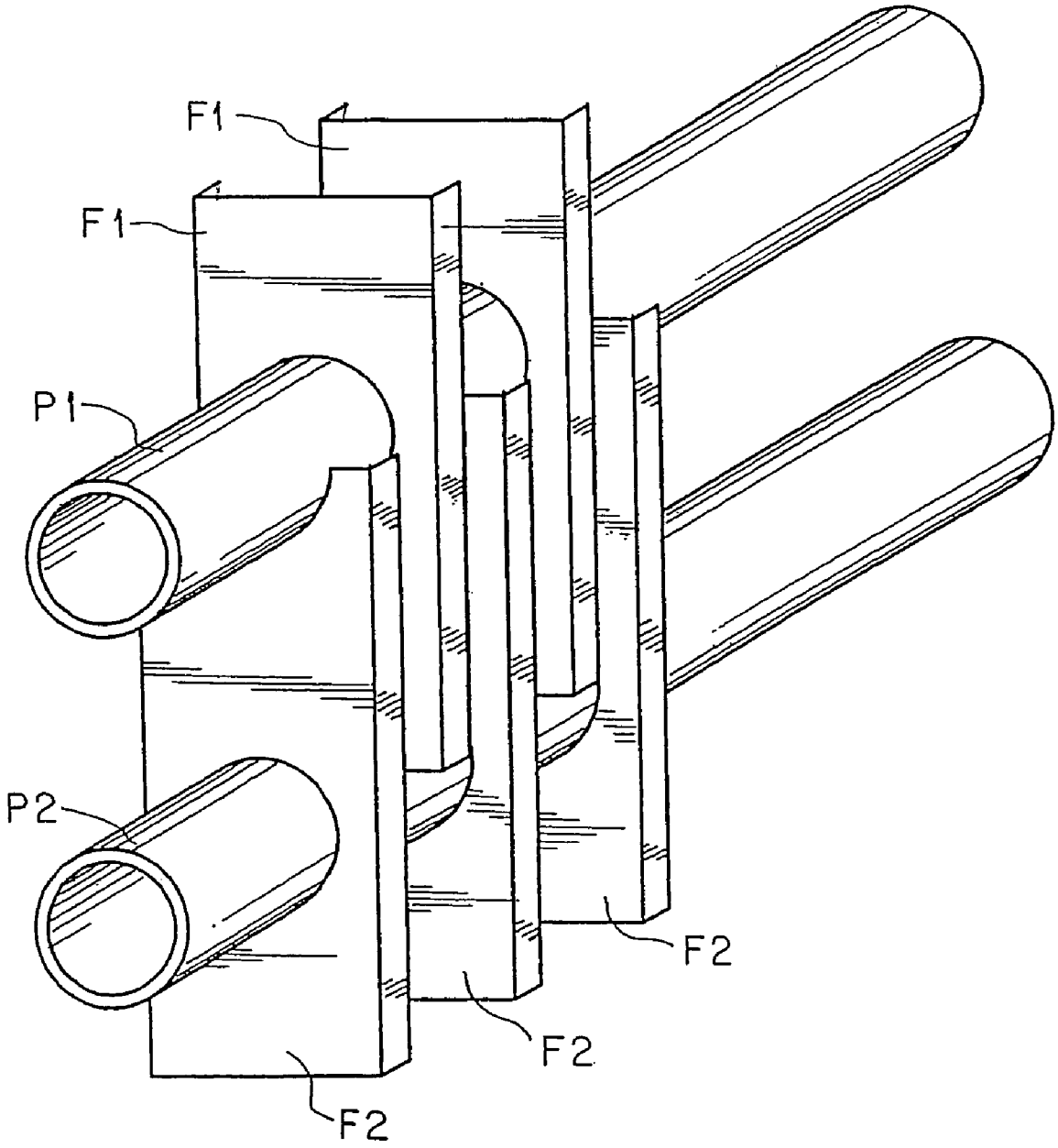
FIG. 9 is a perspective view of a fin construction suitable for use with the base board units in accordance to the invention.
Figure 9B:
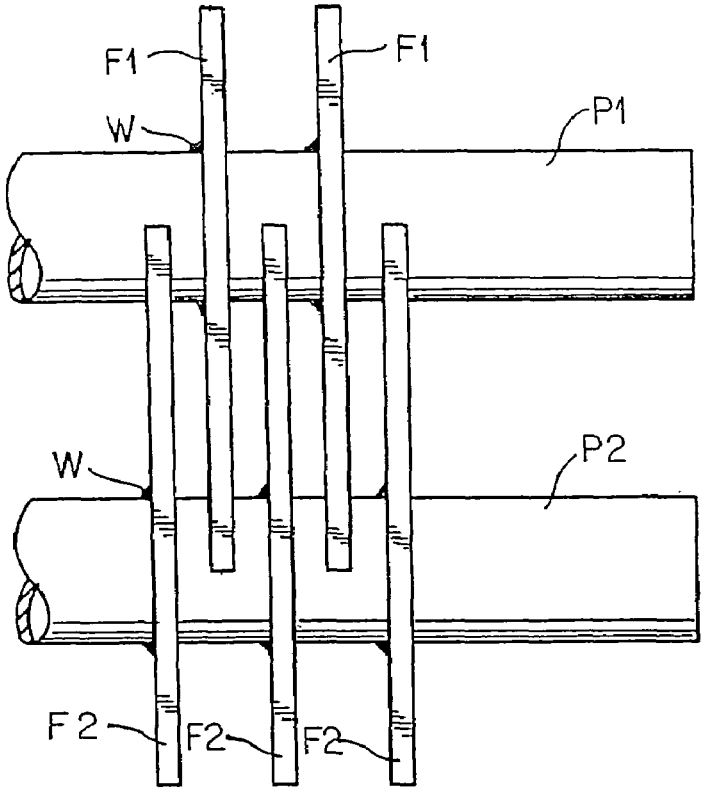
FIG. 9B is a front elevational view of the fin construction shown in FIG. 8.
Figure 9A:
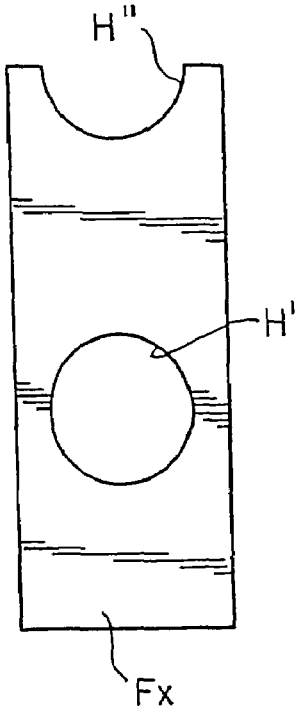
FIG. 9A is a side elevational view of a fin shown in FIG. 9.
Figure 9C:
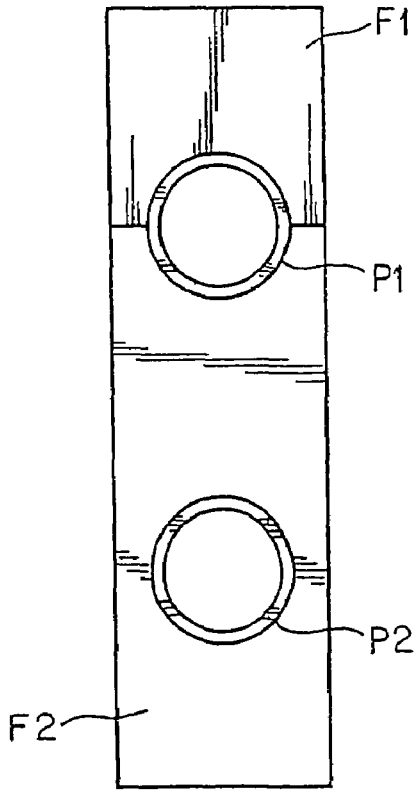
FIG. 9C is a side elevational view of the fin construction shown in FIG. 9.

Referring to FIGS. 9-9*c*, an alternate fin construction is shown that may facilitate assembly of the units. The fins F include a circular hole H' and semi-circulator cut-out H", as shown. By mounting fins F1 on pipe P1 and fins FZ on pipe P2 as shown, the pipes can be rested on each other and properly spaced. In one embodiment, the fins are advantageously welded, at W, to their associated pipes about the peripheries of the holes H'. Since the fins F1 and F2 are identical, only one pipe with fin design need to be used and cut to size on a site and assembled as shown in any desired lengths.

It will also be clear to those skilled in the art that the same baseboard system can be employed in a single enclosure or room or can be extended or carried through multiple rooms by bringing the heated fluid conducting pipes into any enclosures or rooms that need to be heated. The pipes can be looped, as suggested in FIG. 1, and can also be extended from room to room by bringing the pipes through the floors and beneath the floor substructure to another enclosure or room.

What is claimed:

1. A baseboard system comprising a convection baseboard unit to be arranged along a wall proximate to a floor of an enclosure to be heated; heating means within said baseboard unit, said baseboard unit extending in a generally horizontal direction and defining a substantially uniform cross-sectional profile and external surface configuration along said horizontal direction including vertically spaced openings to allow ambient air to flow into and heated air to flow out of said baseboard unit and having a predetermined horizontal width defined by two opposing horizontally spaced lateral ends one at each extreme horizontal position of said baseboard unit; and at least one molding abutting against at least one of said lateral ends of said baseboard unit and having an external surface configuration substantially corresponding to said external surface configuration of said baseboard unit so that said at least one molding abutted against at least one lateral end of said baseboard unit provides a substantially continuous cross-sectional profile and external surface configuration of said baseboard unit beyond the lateral end of said baseboard unit along said horizontal direction along both said baseboard unit and said molding.

2. A baseboard system as defined in claim 1, wherein said baseboard unit is formed of three vertically spaced members, a space between a lower member and an intermediate member forming an inlet opening for admitting ambient air into said baseboard unit and a space between said intermediate member and an upper member forming an outlet opening for discharging heated air.

3. A baseboard system according to claim 2, further comprising attaching means for attaching said members to a wall.

4. A baseboard system according to claim 3, wherein said attaching means includes a backplate secured to the wall, said backplate including protuberances projecting forward away from the wall, at least one of said members being configured to engage said protuberances.

5. A baseboard system according to claim 4, wherein said protuberances comprise substantially horizontal projections inclined relative to a horizontal plane, and at least one of said members is formed of a resilient material and configured with projection-engaging means that clear said projections when said members are deflected from they normal undeflected states and snap into engagement with such projections when released to revert to their undeflected states.

6. A baseboard system according to claim 2, wherein said intermediate member includes brackets for supporting conduits carrying heated fluids.

7. A baseboard system according to claim 6, wherein two conduits are provided.

8. A baseboard system according to claim 7, wherein one conduit is for carrying heated fluid and the other is for carrying fluid that returns in a closed loop system.

9. A baseboard system according to claim 7, wherein both conduits are for carrying heated fluid from a common feeder conduit feeding heated fluid to said baseboard, and a T-shaped coupling for diverting a portion of the heated fluid from the common feeder conduit to each of said conduit with said baseboard.

10. A baseboard system according to claim 9, further comprising deflecting means within said coupling for directing substantially equal amounts of heated fluid to both said conduits.

11. A baseboard system according to claim 6, further comprising heat exchanger means cooperating with said conduits for enhancing the heat exchange between said conduits and the ambient air.

12. A baseboard system according to claim 11, wherein said heat exchanger comprises a plurality of fins in heat exchange contact with said conduit.

13. A baseboard system according to claim 12, wherein said fins have Z-shaped configurations in horizontal planes to enhance the surface areas and heat transfer potential of said fins while reducing the depth of the baseboard unit and projection of the baseboard unit from the wall on which it is mounted.

14. A baseboard system according to claim 2, wherein said upper member comprises a profiled hollow member formed of sheet material.

15. A baseboard system according to claim 2, wherein said lower member comprises a profiled hollow member formed of sheet material.

16. A baseboard system according to claim 15, wherein said lower member has a cross-sectional configuration simulating a shoe and defining an internal area sufficient to serve as a conduit for electrical and data lines and cables.

17. A baseboard system according to claim 2, wherein said moldings are formed of wood.

18. A baseboard system according to claim 2, wherein said moldings are formed of molded wood chipboard material.

19. A baseboard system according to claim 2, wherein said moldings are formed of a molded plastic material.

20. A baseboard system according to claim 2, wherein said moldings are provided with at least one horizontal channel in the region between upper and lower ends of said moldings suitable for receiving heated fluid carrying conduits beyond the lateral ends of said baseboard unit.

21. A baseboard system according to claim 2, wherein said intermediate member is a substantially solid member and at least one horizontal channel in the form of a horizontal recess is provided in said intermediate member, said recess opening rearwardly to open in a direction facing the wall of the enclosure.

22. A baseboard system according to claim 2, wherein said molding includes at least one horizontal raceway at the lower end thereof proximate to the floor of the enclosure for receiving electrical and/or data cables.

23. A baseboard system according to claim 22, wherein said at least one horizontal channel is in the form of a recess in a lower portion of said moldings proximate to the floor of the enclosure and extending rearwardly from a front surface of an intermediate portion of said moldings and a cap cooperating with said moldings to cover said recess and form therewith said horizontal channel.

24. A baseboard system comprising a convection baseboard unit to be arranged along a wall proximate to a floor of an enclosure to be heated; heating means within said baseboard unit, said baseboard unit defining a predetermined external surface configuration including vertically spaced openings to allow ambient air to flow into and heated air to flow out of said baseboard unit and having a predetermined width defined by two opposing lateral ends; moldings abutting at least one lateral end of said baseboard unit and having an external surface configuration substantially corresponding to said external surface configuration of said baseboard unit, whereby abutment of said moldings against at least one lateral end of said baseboard unit substantially continues the external surface configuration of said baseboard unit beyond the lateral end of said baseboard unit to effectively provide a continuous member having a substantially continuous external surface configuration having the appearance of said baseboard and molding extending along at least a portion of a wall of the enclosure, said baseboard unit being formed of three vertically spaced members, a space between a lower member and an intermediate member forming an inlet opening for admitting ambient air into said baseboard unit and a space between said intermediate member and an upper member forming an outlet opening for discharging heated air, and attaching means for attaching said members to a wall, including a backplate secured to the wall, said backplate including protuberances projecting forward away from the wall, at least one of said members being configured to engage said protuberances.

25. A baseboard system comprising a convection baseboard unit to be arranged along a wall proximate to a floor of an enclosure to be heated; heating means within said baseboard unit, said baseboard unit defining a predetermined external surface configuration including vertically spaced openings to allow ambient air to flow into and heated air to flow out of said baseboard unit and having a predetermined width defined by two opposing lateral ends; and moldings abutting at least one lateral end of said baseboard unit and having an external surface configuration substantially corresponding to said external surface configuration of said baseboard unit substantially continues the external surface configuration of said baseboard unit beyond the lateral end of said baseboard unit to effectively provide a continuous member having a substantially continuous external surface configuration having the appearance of said baseboard and molding extending along at least a portion of a wall of the enclosure, said baseboard unit being formed of three vertically spaced members, a space between a lower member and an intermediate member forming an inlet opening for admitting ambient air into said baseboard unit and a space between said intermediate member and an upper member forming an outlet opening for discharging heated air, at least one horizontal channel being in the form of a horizontal recess molded into said intermediate member, said recess opening rearwardly to open in a direction facing the wall of the enclosure.

* * * * *